United States Patent [19]

Muhr et al.

[11] 4,369,907

[45] Jan. 25, 1983

[54] PUNCHING AND RIVETING MACHINE

[75] Inventors: Richard Muhr, Attendorn; Karl Schink, Attendorn-Dünschede, both of Fed. Rep. of Germany

[73] Assignee: Muhr und Bender, Attendorn, Fed. Rep. of Germany

[21] Appl. No.: 193,670

[22] Filed: Oct. 3, 1980

[30] Foreign Application Priority Data

Oct. 6, 1979 [DE] Fed. Rep. of Germany ..... 2940661

[51] Int. Cl.[3] ..... B21J 15/10

[52] U.S. Cl. ..... 227/54; 29/34 B; 227/55; 227/58

[58] Field of Search ..... 227/54, 55, 58, 67; 83/234, 527, 572; 29/34 B, 26 A

[56] References Cited

U.S. PATENT DOCUMENTS

| | | | |
|---|---|---|---|
| 3,030,695 | 4/1962 | White et al. | 29/34 B X |
| 3,534,456 | 10/1970 | Swartz | 227/58 X |
| 3,587,372 | 6/1971 | Prew | 83/527 X |
| 4,091,700 | 5/1978 | Cloup | 83/572 X |
| 4,106,180 | 8/1978 | Fuhrmeister | 227/54 X |

*Primary Examiner*—Gil Weidenfeld
*Assistant Examiner*—Fred A. Silverberg
*Attorney, Agent, or Firm*—Karl F. Ross

[57] ABSTRACT

A puncher-riveter has a fixed lower part having an upper surface and a vertically displaceable upper part above the lower part and having a lower surface. A hydraulic motor vertically displaces the upper part toward and away from the lower part. A punch having a lower punch end is vertically displaceable on the upper part between an upper rest position with the lower end above the lower surface of the upper part and a lower working position with the lower end below this lower surface. A die is provided on the lower part in vertical alignment with the punch so that the lower punch end can engage in the die when the punch is in the lower working position and the upper part is displaced down toward the lower part. A rivet anvil and an embossing tool are provided on the lower surface of the upper part adjacent the punch and a rivet-setting tool has an upper tool end and is vertically displaceable on the lower part between an upper working position with its upper end above the upper surface and a lower rest position with the upper tool end below the upper surface. Thus it is possible with the same machine, simply by switching the punch and rivet-setting tool, to punch and rivet together workpieces in subsequent operations.

13 Claims, 2 Drawing Figures

PUNCHING AND RIVETING MACHINE

FIELD OF THE INVENTION

The present invention relates to a punching and riveting machine.

BACKGROUND OF THE INVENTION

A standard shop-type punching or riveting machine normally has a lower part that is fixed and that serves to support the workpiece being punched or riveted and an upper part that is vertically displaceable by means of a heavy-duty hydraulic actuator toward and away from the lower part. In a riveting machine the lower part normally carries a rivet-setting tool and the upper part constitutes a rivet anvil, or vice versa. In a punching machine the lower part normally is provided with a die and the upper part with a punch. It is also known to provide such a machine, normally on its upper part, with an embossing tool that serves to mark a workpiece in relief.

It has been suggested to combine the functions of these machines so that a single basic unit can perform several functions. This is normally done by means of one or more turrets mounted on the machine parts and each carrying a plurality of different tools. In order to switch from the one type of tool to another the turret or turrets must be rotated to bring the desired tools into alignment. It is also known to provide a quick-release chuck on one of the parts so that various tools can quickly be mounted on it or taken off it.

Such devices have several disadvantages. First of all the relatively complex turret arrangements frequently are only suitable for light-duty application. They cannot withstand substantial forces as needed, for example, in punching metal stock for subsequent setting of rivets. Furthermore they are relatively complicated and expensive. What is more these machines rarely can be adapted for two different types of operations, such as punching and riveting, due to the different requirements and shapes of the different tools needed.

OBJECTS OF THE INVENTION

It is therefore an object of the present invention to provide a multi-purpose machine that can both punch and rivet.

Another object is to provide such a machine which can be set up for heavy-duty punching and riveting, and which can be switched between these two functions relatively rapidly and easily.

SUMMARY OF THE INVENTION

These objects are attained according to the instant invention in a puncher-riveter having upper and lower parts as described above, with the upper part movable by means of a hydraulic motor, which is here meant to include a rotary-type motor, a ram or other suitable prime mover. A punch has a lower punch end and is vertically displaceable on the upper part between an upper rest position with its lower end above the lower surface of the upper part and a lower working position with its lower end below this lower surface. A die on the lower part is in vertical alignment with this punch and the lower punch end is engageable within this die when the punch is in the lower working position on displacement of the upper part down toward the lower part. A rivet anvil is provided on the lower surface of the upper part adjacent the punch and a rivet-setting tool has an upper tool end and is vertically displaceable on the lower part between an upper working position with its upper end above the upper surface and a lower rest position with its upper tool end below the upper surface. Thus it is possible to displace the punch into its lower working position and the rivet-setting tool into its lower rest position for punching with the machine according to this invention, and to displace the punch into the upper rest position and the rivet-setting tool into the upper working position for riveting with the machine according to this invention. It is, of course, possible to make the rivet anvil displaceable instead of the rivet-setting tool and to reverse the upper and lower positions of these parts as well as of the punch and die.

According to further features of this invention the upper part is provided with an embossing tool on its lower surface adjacent the rivet anvil. Thus as the rivets are set the workpiece in the machine according to this invention is marked with appropriate indicia, normally an identification of the manufacturer of the product being punched and riveted. Of course any of many other different types of tools could be substituted for this embossing tool, as well as for the riveting and punching tools.

The punch according to this invention has the above-described lower end, a shaft leading upwardly from it and guided in the upper part of the machine, and a head at its upper end. The upper part to this end is formed with a vertical cylindrical bore snugly and slidably receiving the shaft of the punch.

In order to retain the punch securely in its lower work position according to the instant invention a blocking means is provided. To this end the upper part has an abutment surface which is relatively closely juxtaposed with, even touching the upper surface of the head of the punch in the raised rest position, but which is spaced from it in the lower working position. The blocking means includes a horizontally displaceable slider which can be moved into position between the top of the punch and the abutment surface in the lower working position of the punch. Thus once the punch is moved into this lower position the slider, which can constitute a rigid block of steel, will effectively prevent upward displacement of the punch from the working position. As this block is only in compression it can withstand enormous forces. According to this invention a double-acting hydraulic cylinder can be used to horizontally displace the slider between the blocking position between the abutment surface and punch and the freeing position. Manual actuation is, of course, also possible.

In order to prevent the punch from remaining in the lower working position due to its own weight, a lifting means is provided. This can be a single-acting hydraulic cylinder laterally offset from the punch and connected via an arm to the head of the punch. Once the slider is moved out of the way from above the punch this cylinder is pressurized so as to raise up the punch so that its lower end lies well above the lower surface of the upper part. This displacement cylinder can be double-acting, although it is normally sufficient to let the weight of the punch move it from the rest position into the working position when the cylinder is unpressurized.

Naturally all the above-described actuating means are interconnected so that only one of the displaceable elements can be moved into the working position at the time, with the others automatically being held or moved into the rest position. This can be done by ganging the valves controlling the hydraulic cylinders.

The rivet-setting tool is, as described above, vertically displaceable between its upper working position above the upper surface of the lower part and its lower rest position with its upper end below this upper surface. To this end a displacement wedge is provided which can be moved from a position underneath and supporting the rivet-setting tool in its upper position to a position out from underneath this tool and allowing it to drop to its lower rest position. This wedge has an upper surface engageable with the lower end of the rivet-setting tool and subdivided into an inclined part and a horizontal part. The inclined part is used to displace the rivet-setting tool between its upper and lower positions, and the tool sits on the flat part when in the upper position. Thus this wedge acts similarly to the slider of the punch, lying between the outer end of the rivet-setting tool and an abutment surface in the lower part. This wedge can be manually displaceable or, like the above-described slider, displaceable by a double-acting hydraulic cylinder. Once again, since rivet-setting tool itself is vertically displaceable it can move into the lower position by its own weight.

SPECIFIC DESCRIPTION

Figure 1:
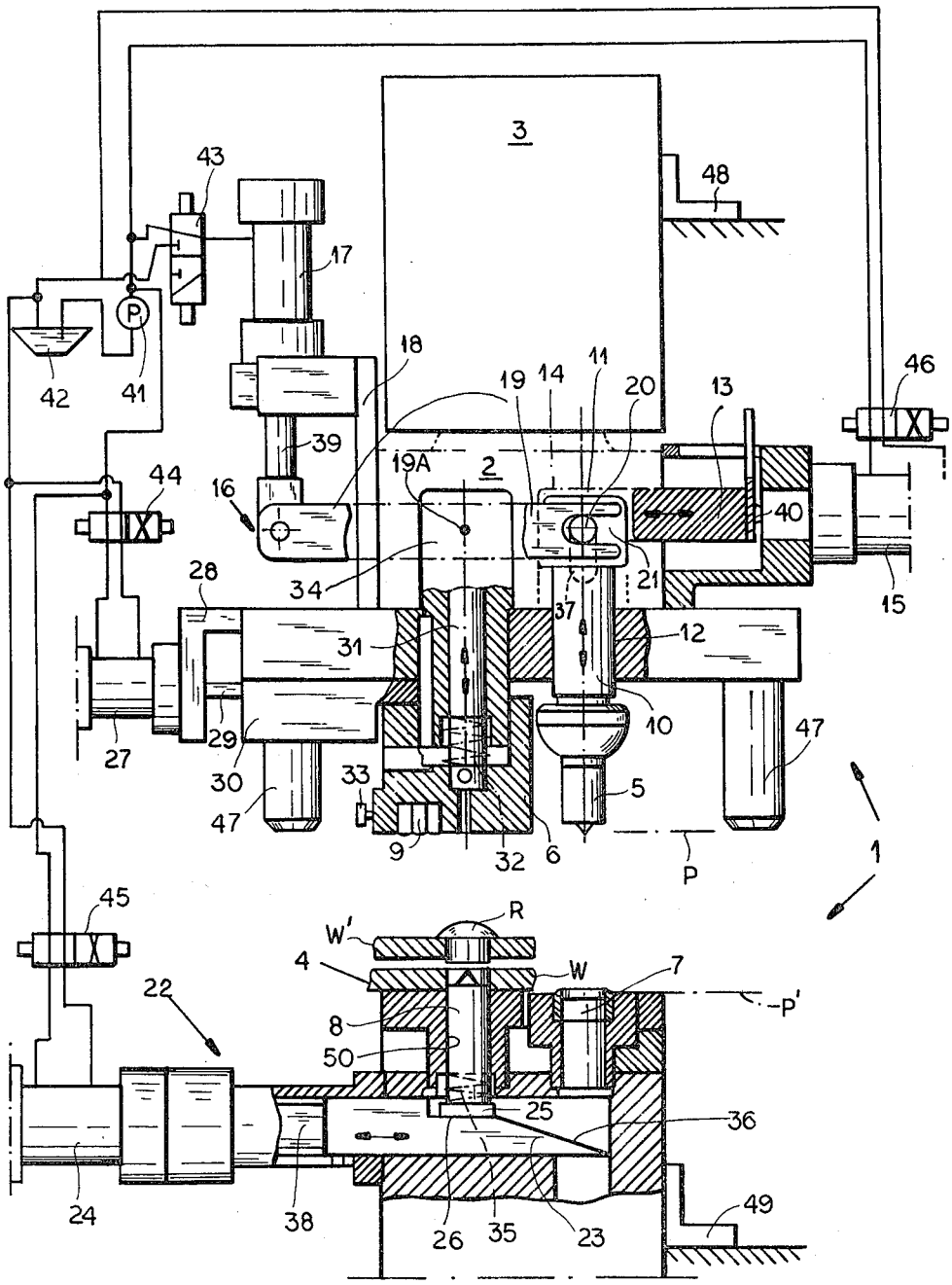
FIG. 1 is a side view partly in schematic form illustrating the machine according to the instant invention.
Figure 2:
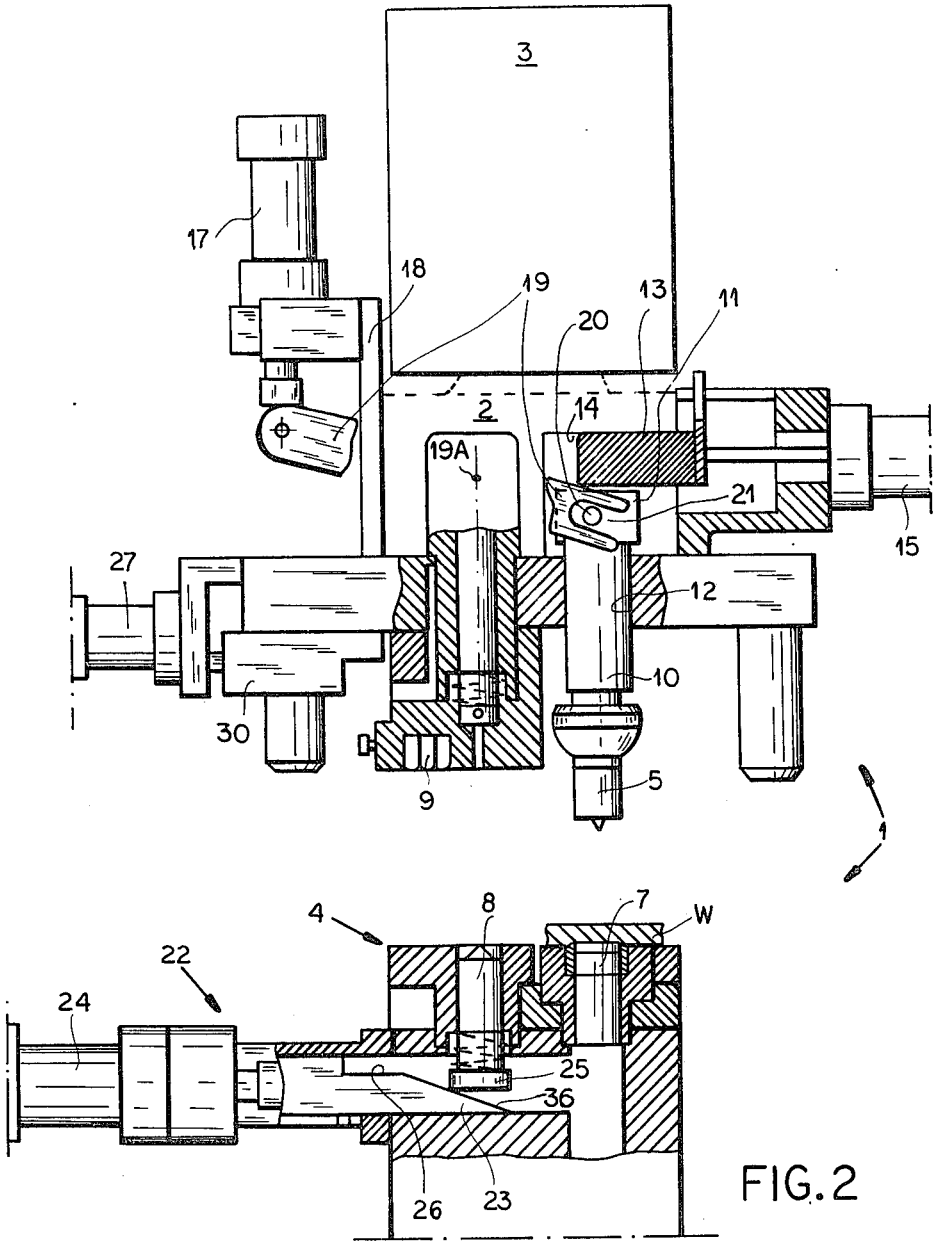
FIG. 2 is a view similar to FIG. 1 showing the machine with its various parts in alternate positions.

As seen in FIGS. 1 and 2 a punching and riveting machine 1 according to the instant invention basically comprises an upper housing or part 2 and a lower workpiece support or part 4. The upper part 2 is vertically displaceable relative to a fixed support 48 by means of a hydraulic actuator or drive which may have a motor 3 either constituted as a rotary motor connected through appropriate gearing to the part 2 or as a simple hydraulic ram. The lower part 4 is made stationary at 49.

The upper part 2 carries a punch 5 and a riveting anvil 6, whereas the lower part 4 carries in vertical alignment underneath these tools a die 7 and a rivet-setting tool 8. In addition the upper part 2 carries adjacent the anvil 6 an embossing tool 9 held in place by a setscrew 33.

The punch 5 has a shaft 10 received in a cylindrical bore 12 of the upper part 2 and has at its upper end a head 11 formed with a vertically elongated slot 37 and provided with a pin 20 extending horizontally through this slot 37. The punch 5 is displaceable vertically in the part 2 by means of an actuator 16 constituted as a single-acting hydraulic cylinder 17 fixed by a bracket 18 on the part 2 and having a downwardly projecting piston rod 39. Pivoted on this piston rod 39 is a lever 19 pivoted at 19A on the housing 2 and having an opposite end constituted as a fork forming a slot 21 engaging the pin 20. The cylinder 17 can have its back chamber pressurized through a valve 43 from a pump 41 as shown in FIG. 1 or can have this back chamber connected to a reservoir 42 so that the fluid can drain out at atmospheric pressure.

A slider 13 is displaceable horizontally in the working lower position of the punch 5 as shown in FIG. 2 into a position with its lower surface lying above the upper end of the head 11 of the punch 5 and its upper surface bearing against a horizontal abutment surface 14 of the upper part 2. A double-acting hydraulic cylinder 15 has its piston rod 40 connected to this slider 13 to displace it between its two end positions shown respectively in FIGS. 1 and 2. A four-port reversing valve 46 connects the two chambers of this cylinder 15 to the pump 41 and reservoir 42 for alternate pressurization and emptying of its front and back chambers.

The lower end of the punch 5 can fit into the die 7 which to this end is formed with a vertically throughgoing cylindrical passage of substantially the same size and shape as the die 5. Thus in the lower position of FIG. 2 the punch 5 can pass through a workpiece W and punch out a round disk of material.

The riveting anvil 6 and the embossing tool 9 are carried on the lower end of a rod 31 linearly vertically displaceable in a guide 34 of the upper part 2. A double-acting hydraulic cylinder 27 which can be operated through a valve 44 identical to the valve 46 is mounted via a bracket 28 on the upper part 2 and has a piston rod 29 connected to a slider 30 which can engage between the upper portion of the anvil 6 and the housing part 2. A compression spring 32 normally urges the anvil 6 and an embossing tool 9 downward into the position illustrated in FIG. 1.

The rivet-setting tool 8 is of the same cylindrical size and shape as the punch 5 and is guided in a cylindrical bore 50 of the lower part 4, with a compression spring 35 serving to urge it downward. This tool 8 has at its lower end a foot 25 which can ride on an inclined surface 36 or a horizontal surface 26 of a wedge 23. An actuator 22 has a pressurizable cylinder 24 whose piston rod 38 carries the wedge 23. Thus this actuator 22 can displace the rivet-setting tool 8 between the upper working position shown at FIG. 1 and the lower rest position shown in FIG. 2.

In addition the upper part 2 carries a pair of hold-down rods 47 whose lower ends are substantially coplanar with the lower surface of the anvil 6 in the lower position thereof, which plane P is vertically offset from the plane P′ of the upper surface of the lower part 4.

In use a workpiece W is placed between the upper and lower parts 2 and 4. The cylinder 17 is operated to move the punch 5 into the lower position shown in FIG. 2. Similarly the cylinder 27 is operated to move the slider 30 out from above the anvil 6 and the cylinder 15 is operated to move the slider 13 into the working position above the head 11 of the punch 5. The cylinder 24 draws the wedge 23 back to allow the foot 25 of the tool 8 to slide down on the inclined surface 36. In this position a workpiece W positioned over the hole of the die 7 can have a circular disk of material punched out of it by the punch 5 by forceable lowering of the upper part 2 by means of the actuator 3. In FIG. 2 the anvil 6 is shown in an upper position which it only assumes when pressed upwardly, as the slider 30 is only moved out of the way to completely eliminate the possibility of accidently striking or embossing the surface of the workpiece W during punching.

Subsequently the positions of all cylinders are reversed so that all of the structure resumes the positions of FIG. 1. Thus the wedge 23 is advanced to move up the rivet-setting tool 8, the slider 13 is withdrawn and the cylinder 17 is pressurized to lever up the punch 15. The slider 30 is displaced above the anvil 6 to prevent it from moving upwardly. In this position another workpiece W′ provided with a rivet R is set over the workpiece W whose hole is aligned on the rivet-setting tool 8. Operation of the actuator 3 will therefore upset the rivet by means of the tool 8 and secure the workpieces W and W' closely together. At the same time the embossing tool 9 will appropriately mark the upper workpiece W'.

Thus with the machine according to the instant invention it is possible to carry out subsequent punching and riveting operations in an extremely simple manner. All of the various controlled valves 43–46 are ganged so that a single lever of the like need only be actuated by the operator of the machine switch them all from one of their positions to the other of their positions. In this manner it is possible to punch and rivet together metal sheet or the like in an extremely simple and rapid manner.

We claim:

1. A puncher-riveter comprising:

a fixed lower part having an upper surface;

a vertically displceable upper part above said lower part and having a lower surface;

hydraulic means for vertically displacing said upper part toward and away from said lower part;

a punch having a lower punch end vertically displaceable on said upper part between an upper rest position with said lower end above said lower surface and a lower working position with said lower end below said lower surface, said punch having an upper end formed as a punch head and a shaft interconnecting said head and lower end, said shaft being slidably guided in said upper part, said upper part having an abutment surface relatively closely juxtaposed with said head in said upper position of said punch and relatively far from said head in said lower position of said punch;

a slider displaceable when said punch is in said lower position between a blocking position between said head and said abutment surface for preventing upward displacement of said punch into said upper position and a position out of the way of said punch for permitting upward displacement of same into said upper position;

a die on said lower part in vertical alignment with said punch, said lower punch end being engageable in said die with said punch in said lower working position on displacement of said upper part down toward said lower part;

a rivet anvil on said lower surface of said upper part adjacent said punch; and a rivet-setting tool having an upper tool end and vertically displaceable on said lower part below said rivet anvil between an upper working position with said upper end above said upper surface and a lower rest position with said upper tool end below said upper surface.

2. The machine defined in claim 1, further comprising an embossing tool on said lower surface adjacent said rivet anvil.

3. The machine defined in claim 1, further comprising means including a hydraulic actuator on said upper part for horizontally displacing said slider between the respective blocking and out-of-the-way positions.

4. The machine defined in claim 1, further comprising means on said upper part for displacing said punch between the respective upper and lower positions.

5. The machine defined in claim 4 wherein said means for displacing said punch engages said head thereof.

6. The machine defined in claim 5 wherein said means for displacing said punch includes a hydraulic actuator engaging said head.

7. The machine defined in claim 6 wherein said hydraulic actuator is horizontally offset from said punch and is provided with a horizontally extending arm connected to said head.

8. The machine defined in claim 1, further comprising means for displacing said rivet-setting tool in a displacement direction between the respective upper and lower positions.

9. The machine defined in claim 8 wherein said means for displacing said tool includes a wedge horizontally displaceable in said lower part between a position underneath said tool for holding up said tool and a position out from underneath said tool for permitting same to drop down into the respective lower positions.

10. The machine defined in claim 9 wherein said wedge has an upper face engageable with said tool, said upper fore having a portion inclined to the displacement direction of said tool and a portion substantially perpendicular to said direction, said tool resting on the latter portion when in said upper position.

11. The machine defined in claim 1, further comprising a spring urging said tool into the respective lower position.

12. The machine defined in claim 1 wherein said tool is an upright cylinder and said upper end thereof is formed with a point.

13. The machine defined in claim 1 wherein said tool and said punch are of substantially the same cylindrical size and shape.

* * * * *